US005413533A

United States Patent [19]

Bolus et al.

[11] Patent Number: 5,413,533

[45] Date of Patent: May 9, 1995

[54] AIMING APPARATUS FOR BOWLING HAVING PIVOTAL TARGETS

[76] Inventors: Edward Bolus, 700 North Keyser Ave., Scranton, Pa. 18504; Anthony Bergamino, 2828 Rock Rd., Newtown Ransom, Pa. 18411

[21] Appl. No.: 101,478

[22] Filed: Aug. 3, 1993

[51] Int. Cl.[6] ..... A63D 5/04; A63B 69/36

[52] U.S. Cl. ..... 473/55; 473/64; 473/58; 273/177 A

[58] Field of Search ..... 273/181 J, 375, 177 A; 473/55, 58, 75, 64

[56] References Cited

U.S. PATENT DOCUMENTS

| | | | |
|---|---|---|---|
| 1,807,074 | 5/1931 | Shears | 273/375 |
| 2,210,398 | 8/1940 | Dunlap | 273/37 |
| 2,466,103 | 4/1949 | Hiester | 273/37 |
| 2,990,177 | 6/1961 | Hutchison | 273/51 |
| 3,015,685 | 10/1963 | Jahn | 473/55 |
| 3,094,330 | 6/1963 | Smith | 473/55 |
| 3,105,685 | 10/1963 | Jahn | 273/54 |
| 3,120,956 | 2/1964 | Burgess | 273/54 |
| 3,301,558 | 1/1967 | Clapham | 273/51 |
| 3,473,804 | 10/1969 | Pecora | 273/54 |
| 3,791,653 | 2/1974 | Yamada | 273/177 A X |
| 3,873,097 | 3/1975 | Willis | 273/177 A X |
| 5,181,721 | 1/1993 | Halliburton | 273/181 J X |

*Primary Examiner*—Vincent Millin
*Assistant Examiner*—William M. Pierce
*Attorney, Agent, or Firm*—DeLio & Peterson

[57] ABSTRACT

An aiming apparatus for a bowling alley comprising an elongated member, means for supporting the elongated member in a substantially horizontal position above and across the bowling alley, the elongated member being substantially perpendicular to the axis of the bowling alley, and a plurality of independently hanging target panels rotatably attached to the elongated member in a manner such that the target panels are uniformly spaced across the full width of the bowling alley, each of said target panels indicating a corresponding travel path of a bowling ball, said elongated member being positioned above the bowling alley in a manner such that the bowling ball contacts and deflects the bottom portion of an individual one of the targets so as to mark the path of the bowling ball.

4 Claims, 3 Drawing Sheets

AIMING APPARATUS FOR BOWLING HAVING PIVOTAL TARGETS

BACKGROUND OF THE INVENTION

1. Field of the Invention

The present invention relates to a bowling assist device, and more particularly, to an apparatus for spotting the path of a bowling ball.

2. Description of Related Art

There have been several attempts to provide assistance to bowlers in improving their aim. One such attempt is described in U.S. Pat. No. 3,105,685 entitled "Bowling Target" issued Oct. 1, 1963 to Jahn which discloses the utilization of a pair of target strips hanging over the lane at a point along the bowling alley. The target strips are adjusted so that the bowler is to roll the ball between the strips in order to mark a particular predefined path. The target strips may be moved to any desired position over the alleys. A disadvantage of the device disclosed in Jahn is that the target strips must constantly be adjusted if the bowlers want to aim for different bowling pins. This disadvantage would significantly increase the amount of time needed to play a game.

Another attempt to provide a device which improves a bowler's aim is disclosed in U.S. Pat. No. 3,473,804 entitled "Bowling Trainer" issued Oct. 21, 1969 to Pecora. Pecora discloses the utilization of a second pair of target strips behind a first pair in order to provide a pair of spaced targets through which the ball is to roll. The disadvantage of Pecora is the same as that of Jahn U.S. Pat. No. 3,105,685, i.e., the bowlers must constantly readjust the targets if the bowlers desire to aim for different bowling pin locations.

Another attempt to provide a system that aids bowlers in improving their aim is described in U.S. Pat. No. 2,990,177 entitled "Illuminated Inserts For Spot Bowling" issued Jun. 27, 1961 to Hutchinson which discloses the utilization of illuminated inserts, i.e., electric inserts, which may be individually lit in the alley. A disadvantage of Hutchinson is that the alley bed must be configured to receive the illuminated inserts, i.e., recesses must be formed in the alley bed to accept the translucent plastic material. This is an expensive process which owners of bowling alleys might not be willing to undertake. Additionally, the circuit comprising the switches, electric lights and corresponding wiring is complex and is expensive to manufacture. Furthermore, the electric lights will frequently burn out and have to be replaced. Hence, the maintenance of such a system can be expensive in the situation where a bowling facility has many alleys which utilize this system.

Bearing in mind the problems and deficiencies of the prior art, it is therefore an object of the present invention to provide a new and improved apparatus to spot the path of a bowling ball which can be easily transported and assembled.

It is another object of the present invention to provide a new and improved apparatus to spot the path of a bowling ball which enables the user of the apparatus to aim for any one particular path without having to make adjustments or readjustments to the apparatus.

It is yet another object of the present invention to provide a new and improved apparatus to spot the path of a bowling ball that utilizes a plurality of target panels, each of which indicating a corresponding travel path of a bowling ball.

It is another object of the prevent invention to provide a new and improved apparatus to spot the path of a bowling ball which aids sight impaired bowlers in identifying a desired travel path of the bowling ball.

It is a further object of the present invention to provide a new and improved apparatus to spot the path of a bowling ball that is light in weight and of very simple construction.

It is yet another object of the present invention to provide a new and improved apparatus to spot the path of a bowling ball which is relatively inexpensive to manufacture.

SUMMARY OF THE INVENTION

The above and other objects, which will be apparent to those skilled in the art, are achieved in the present invention which is directed to an aiming apparatus for a bowling alley comprising an elongated member, means for supporting the elongated member in a substantially horizontal position above and across the bowling alley, the elongated member being substantially perpendicular to the axis of the bowling alley, and a plurality of independently hanging target panels rotatably attached to the elongated member in a manner such that the target panels are uniformly spaced across the full width of the bowling alley, each of the target panels indicating a corresponding travel path of a bowling ball, the elongated member being positioned above the bowling alley in a manner such that the bowling ball contacts and deflects the bottom portion of an individual one of the targets so as to mark the path of the bowling ball.

BRIEF DESCRIPTION OF THE DRAWINGS

For a full understanding of the invention, reference should be made to the following description taken in connection with the accompanying drawings in which.

DESCRIPTION OF THE PREFERRED EMBODIMENTS

Figure 1:
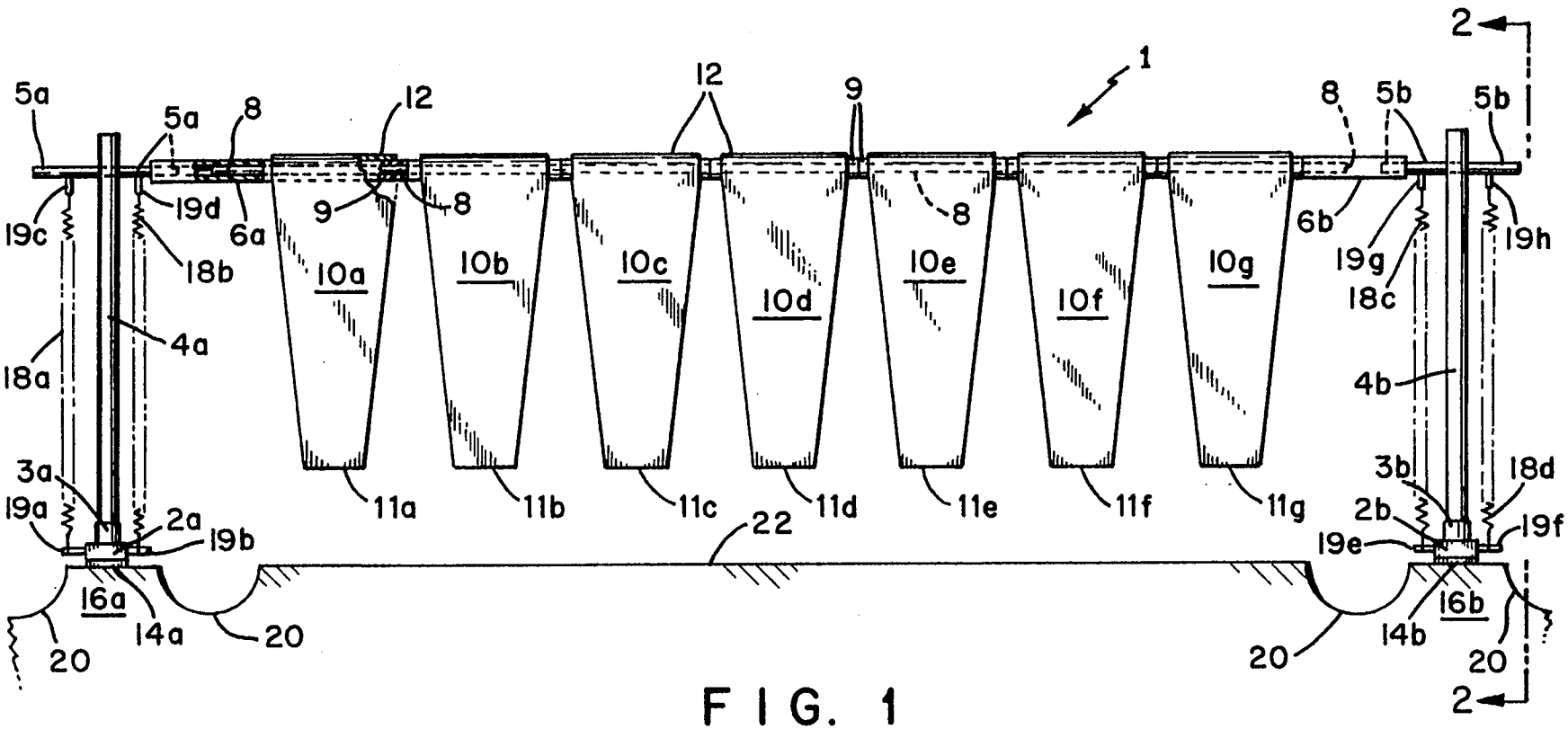
FIG. 1 is a front elevational view of the aiming apparatus of the present invention.
Figure 2:
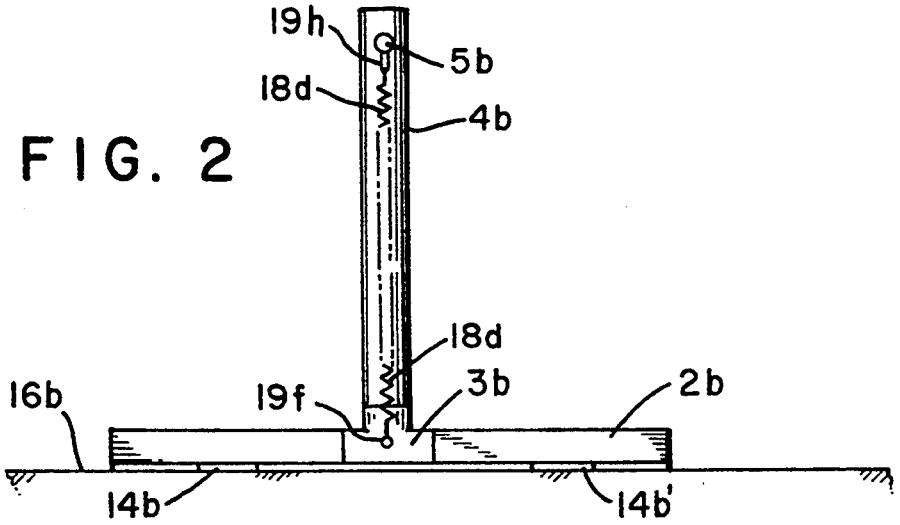
FIG. 2 is a side elevational view taken along line 2—2 in FIG. 1.

Referring to FIGS. 1 and 2, aiming apparatus 1 of the present invention comprises generally of horizontal support bar 8, vertical support members 4*a*, 4*b*, and transverse members or feet 2*a*, 2*b*. Velcro strips 14*a*, 14*b* are placed on the bottom surface of each member 2*a*, 2*b*, respectively so as to contact corresponding velcro strips (not shown) positioned on lane or alley separators 16*a*, 16*b*, respectively. Each velcro strip 14*a*, 14*b* (14*b*') is about 2 inches wide and 2 inches long. The utilization of the velcro strips in this instance adds stability to apparatus 1 and prevents the apparatus from sliding or falling off alley or lane separators 16*a*, 16*b*. T-shaped members 3*a* and 3*b* are fixed to members 2*a* and 2*b*, respectively. Transverse members 2*a*, 2*b* have a length of about 24 inches. The bottom ends of vertical support members 4*a* and 4*b* are disposed within top openings (not shown) of T-shaped members 3*a* and 3*b*, respectively. Vertical support members 4*a*, 4*b* have a height of about 20 inches. Horizontal support bar 8 has each end thereof disposed within a corresponding bore of tubular members 6*a* and 6*b*. In a preferred embodiment, support bar 8 is fabricated from steel tubing and is about ½ inch in diameter and about 66 inches in length. Preferably, support bar 8 is positioned at a height of about 18 inches above the bowling alley. Tubular members 6*a* and 6*b* are removably mounted to vertical support members 4*a* and 4*b*, respectively, via cylindrical inserts 5*a* and 5*b*, respectively. Inserts 5*a*, 5*b* are disposed within corresponding bores in the upper portions of vertical support members 4*a*, 4*b*, respectively. Tubular members 6*a*, 6*b* are fabricated from plastic or polyvinyl chloride (p.v.c.) and are about 2 inches in diameter and about 11 inches in length.

Spring member 18*a* is interposed between cylindrical insert 5*a* and transverse member 2*a*. Spring member 18*b* is interposed between tubular member 6*a* and transverse member 2*a*. Similarly, spring member 18*c* is interposed between cylindrical insert 5*b* and transverse member 2*b*. Spring member 18*d* is interposed between cylindrical insert 5*b* and transverse member 2*b*. Each spring member 18*a–d* has each end thereof fastened to a corresponding eye-hook 19*a–h*. Spring members 18*a–d* add structural support to the entire aiming apparatus.

Vertical support members 4*a*, 4*b* are provided with a plurality of longitudinally spaced openings which are capable of receiving inserts 5*a*, 5*b*, respectively, so as to allow the height of horizontal support bar 8 to be varied within the range from about 15 inches to about 18 inches, depending on the accuracy desired by the bowlers. Smaller size spring members 18*a–d* may be utilized when support bar 8 is at a minimum height above the bowling alley.

Figure 3:
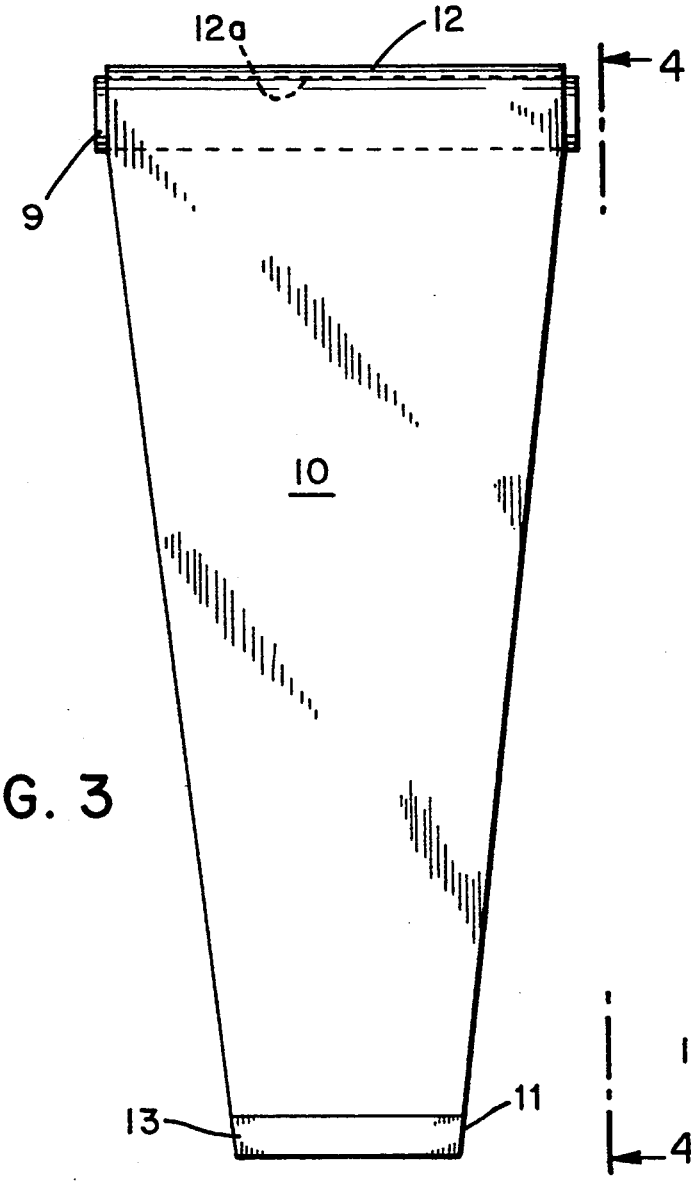
FIG. 3 is a close-up front elevational view of an individual target panel utilized by the aiming apparatus of the present invention.
Figure 4:
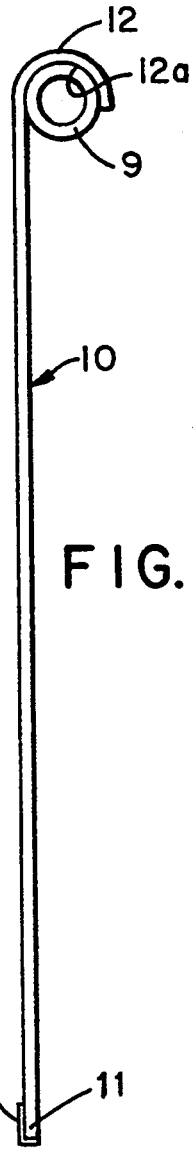
FIG. 4 is a side elevational view taken along line 4—4 of FIG. 3.

Target panels 10*a–g* are rotatably and slidably attached to horizontal support bar 8 and are uniformly spaced across the full width of bowling alley 22. Referring to FIGS. 3 and 4, upper portion 12 of each target panel (shown as 10) is curved so as to form groove 12*a*. Tubular member 9 is frictionally inserted into groove 12*a* and has an inner diameter that is slightly larger than the outer diameter of horizontal support bar 8 so as to facilitate rotation of each target panel 10*a–g* about support bar 8. In a preferred embodiment, each tubular member 9 is fabricated from p.v.c. tubing, has a length of 5¼ inches and an outer diameter of ~ inch. The larger inner diameter of each tubular member 9 also allows the user of apparatus 1 to slidably mount each target panel on support bar 8 during assembly of the apparatus. Hence, each target panel 10*a–g* can move axially and rotatably upon support bar 8. Each target panel 10*a–g* is fabricated from ⅛ inch thick plexiglass, and is about 5 inches wide at upper portion 12, and tapers to a width of about 2½ inches at lower portion 11. Thus, each target panel is sufficiently light in weight so as to not significantly alter the velocity of the bowling ball. Each target 10*a–g* is about 12 inches in length from upper portion 12 to lower portion 11. Tubular members 6*a*, 6*b* keep each target panel 10*a–g* positioned over its corresponding section of alley 22 and prevent each target panel from axially moving away from its corresponding section. The bottom portion 11*a–g* of each target panel 10*a–g* is covered with a thin rubber layer or shim 13 to absorb the impact of the contact between the bowling ball and the target panel and to prevent deflection of the bowling ball as it passes through aiming apparatus 1. Shim 13, if utilized, can be glued or taped to bottom portion 11*a–g* of each target panel 10*a–g*, respectively. Preferably, rubber shim 13 is about two (2) inches in length. Each target panel 10*a–g* is a different color so as to aid the bowler in quick identification of the area to which he or she must direct the bowling ball. Additionally, target panels having different geometric shapes can also be utilized.

Figure 5:
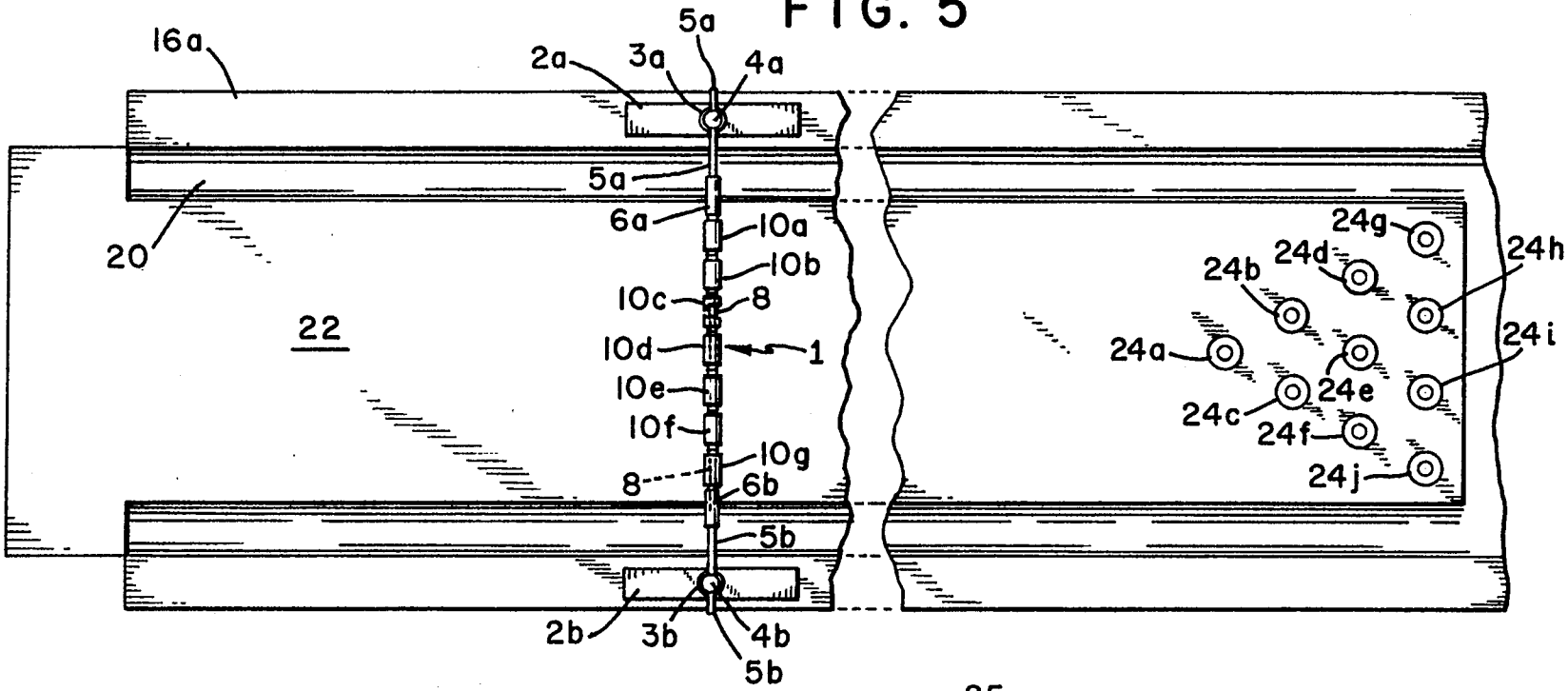
FIG. 5 is a top plan view of a bowling alley equipped with the aiming apparatus of the present invention.

Referring to FIG. 5, aiming apparatus 1 is positioned over alley 22 in a manner such that transverse members 2*a*, 2*b* are longitudinally positioned upon lane separators 16*a*, 16*b*, respectively, and horizontal support bar 8 is substantially perpendicular to the axis of alley 22 (see also FIG. 2). Each target panel 10*a–g* corresponds to a path on which the bowler may desire to have his or her ball roll. For instance, if the bowler desires to knock down pin 24*j*, he or she might throw the ball so that it will contact target 10*g*. However, the bowlers may use targets 10*a–g* in any manner so as to improve their game. For instance, if a bowler knows that he or she utilizes a "curve" in his or her toss, he or she may aim for target 10*g* so as to hit pin 24*a*. Furthermore, if a bowler desires to concentrate on directing the bowling ball to a specific path, the bowler may assemble aiming apparatus 1 so as to utilize only one of the target panels which may be slidably adjusted so as to designate or spot a specific path.

Figure 6:
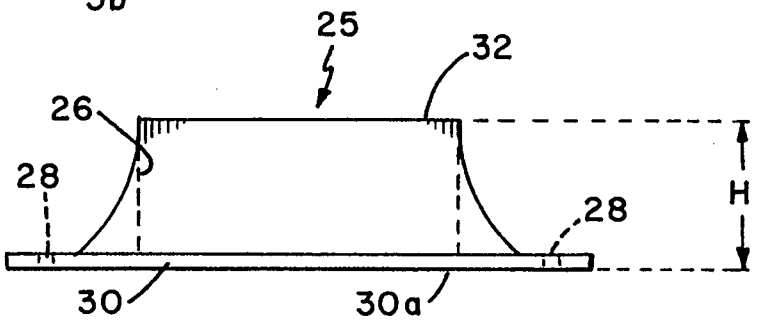
FIG. 6 is a front elevational view of a mounting plate which can be utilized with the aiming apparatus of the present invention.

In an alternate embodiment, transverse members 2*a* and 2*b* and spring members 18*a–d* may be replaced by mounting plates 25 (see FIG. 6) which are attached rigidly to bowling alley lane separators 16*a* and 16*b*. Each mounting plate has an opening 26 to receive the bottom end of a corresponding vertical support member 4*a*, 4*b*. Each mounting plate also has a plurality of apertures 28 for receiving fasteners, i.e., screws, nails, etc. which are utilized to attach the mounting plate to the lane separator. Base 30 of mounting plate 25 is substantially flat and has a length of about 3 inches. The height of the mounting plate (designated by the letter "H"), between top portion 32 and bottom surface 30*a*, may be from about 1 inch to about 2 inches. In a preferred embodiment, mounting plate 25 is fabricated from steel.

Aiming apparatus 1 enhances a bowler's concentration and facilitates identification of the proper path on which to direct the bowling ball in order to contact specific bowling pins. The apparatus of the present invention also facilitates instructing younger bowlers, e.g., children who do not yet have a grasp on the fundamentals of the game of bowling. The aiming apparatus of the present invention also provides visual aids to the bowlers who are sight impaired since the bright colors of the target panels facilitate quick identification of a desired path. The lightweight and simplicity of the construction of apparatus 1 facilitates portability of the apparatus. The apparatus can be assembled and disassembled with ease.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A bowling aiming apparatus for use with a bowling alley having a width and being positioned between a pair of bowling alley separators which separate the bowling alley from adjacent bowling alleys, said bowling aiming apparatus, comprising:

an elongated member;

a pair of support structures, each of which being removably attachable to a corresponding bowling alley separator, said elongated member having each end thereof attached to a corresponding support structure, each support structure having a height within a predetermined range of heights wherein each of said structures includes means for varying the height of said elongated member within the predetermined range of heights; and a plurality of independently hanging target panels rotatably attached to said elongated member, each of said target panels comprising a planar body having a first side and a second side, each of said target panels having a top end adjacent said elongated member and a bottom end opposite said top end, each of said target panels having a taper intermediate said top and bottom ends wherein the width of said top end is greater than the width of said bottom end, said taper of each target panel facilitating aiming for a specific area of the bowling alley, each of said target panels indicating a corresponding travel path of a bowling ball whereby the bowling ball contacts said first side of and deflects one of said target panels in order to pass under said elongated member and indicate the path of the bowling ball.

2. The aiming apparatus of claim 1 wherein said plurality of target panels comprises seven (7) targets.

3. In combination with a bowling alley having a width and being positioned between a pair of bowling alley separators which separate the bowling alley from adjacent bowling alleys, the bowling alley having a first end for receiving a bowling ball and a second end for placement of bowling pins, a bowling aiming apparatus comprising an elongated member, a pair of vertical support members, each of which being mounted to a corresponding bowling alley separator and having a plurality of longitudinally spaced openings for receiving a corresponding end of said elongated member, said support members supporting said elongated member in a substantially horizontal position substantially transverse to and above the bowling alley, said spaced openings in each vertical support member permitting the height of said elongated member above the bowling alley floor to be varied, and a plurality of independently hanging target panels rotatably attached to said elongated member, each of said target panels comprising a planar body having a first side and a second side, said first side facing said first end of the bowling alley and said second side facing said second end of the bowling alley, each of said target panels having a top end adjacent said elongated member and a bottom end opposite said top end, each of said target panels having a taper intermediate said top and bottom ends wherein the width of said top end is greater than the width of said bottom end, said taper of each target panel facilitating aiming for a specific area of the bowling alley, each of said target panels indicating a corresponding travel path of a bowling ball, said elongated member being positioned above the bowling alley in a manner such that the bowling ball contacts said front side of and deflects one of said target panels in order to pass under said elongated member and indicate the path of the bowling ball.

4. A bowling aiming apparatus for use with a bowling alley having a width and being positioned between a pair of bowling alley separators which separate the bowling alley from adjacent bowling alleys, said bowling aiming apparatus, comprising:

an elongated member;

a pair of vertical support members, each of which being removably attachable to a corresponding bowling alley separator and having a plurality of longitudinally spaced openings for receiving a corresponding end of said elongated member, said vertical support members supporting said elongated member in a substantially horizontal position substantially transverse to and above the bowling alley, said spaced openings in each vertical support member permitting the height of said elongated member above the bowling alley floor to be varied between about 15 inches and 18 inches, depending on the accuracy desired by a bowler;

seven (7) independently hanging target panels uniformly spaced upon and rotatably attached to said elongated member, each of said target panels comprising a planar body having a first side and a second side, each of said target panels having a top end adjacent said elongated member and a bottom end opposite said end, each of said target panels having a taper intermediate said top and bottom ends wherein the width of said top end is greater than the width of said bottom end, said taper of each target panel facilitating aiming for a specific area of the bowling alley, said target panels being uniformly spaced across substantially the full width of the bowling alley when said elongated member is positioned over the bowling alley, each of said target panels indicating a corresponding travel path of a bowling ball whereby the bowling ball contacts said first side and deflects one of said target panels in order to pass under said elongated member and indicate the path of the bowling alley.

* * * * *

UNITED STATES PATENT AND TRADEMARK OFFICE

CERTIFICATE OF CORRECTION

PATENT NO. : 5,413,533

DATED : May 9, 1995

INVENTOR(S) : Edward Bolus & Anthony Bergamino

It is certified that error appears in the above-identified patent and that said Letters Patent is hereby corrected as shown below:

In column 3, line 51, please delete ~ and insert - -3/4- -.

Signed and Sealed this

Twenty-seventh Day of June, 1995

Bruce Lehman

*Attest:*

BRUCE LEHMAN

*Attesting Officer*

*Commissioner of Patents and Trademarks*